US006289819B1

(12) United States Patent
Dolderer

(10) Patent No.: US 6,289,819 B1
(45) Date of Patent: Sep. 18, 2001

(54) PAINT BALL LAND MINE

(76) Inventor: Daniel W. Dolderer, 1499 Grontham School Rd., Mt. Olive, NC (US) 28365

( * ) Notice: Subject to any disclaimer, the term of this patent is extended or adjusted under 35 U.S.C. 154(b) by 0 days.

(21) Appl. No.: 09/246,904

(22) Filed: Feb. 8, 1999

Related U.S. Application Data

(60) Provisional application No. 60/074,760, filed on Feb. 17, 1998.

(51) Int. Cl.[7] ..... F42B 8/00; F42B 12/38

(52) U.S. Cl. ..... 102/513; 102/407; 102/498; 102/529

(58) Field of Search ..... 102/407, 498, 102/513, 529

(56) References Cited

U.S. PATENT DOCUMENTS

| | | | | |
|---|---|---|---|---|
| D. 366,283 | | 1/1996 | Fernandes | D21/2 |
| 2,475,008 | | 7/1949 | Catherwood, Jr. | 102/8 |
| 2,972,949 | | 2/1961 | Mac Leod | 102/67 |
| 4,656,092 | * | 4/1987 | Haman et al. | 102/513 |
| 4,690,061 | * | 9/1987 | Armer, Jr. et al. | 102/401 |
| 4,833,961 | | 5/1989 | Adini | 89/1.1 |
| 5,149,290 | | 9/1992 | Reveen | 446/475 |
| 5,207,579 | | 5/1993 | Campagnuolo | 434/11 |
| 5,254,379 | * | 10/1993 | Kotsiopoulos | 102/513 |
| 5,448,951 | * | 9/1995 | Olsen | 102/513 |
| 5,526,750 | * | 6/1996 | Poor et al. | 102/361 |
| 5,590,886 | | 1/1997 | Lush | 473/577 |
| 5,639,526 | * | 6/1997 | Kotsiopoulos et al. | 102/513 |
| 5,698,813 | * | 12/1997 | Ramsey et al. | 102/407 |
| 5,877,448 | * | 3/1999 | Denton et al. | 102/401 |
| 5,936,190 | * | 8/1999 | Buzick | 102/513 |
| 5,996,503 | * | 12/1999 | Woodall et al. | 102/529 |

* cited by examiner

*Primary Examiner*—Peter A. Nelson
(74) *Attorney, Agent, or Firm*—Mills Law Firm PLLC

(57) ABSTRACT

A paint ball land mine capable of propelling standard caliber paint balls during simulated war games is disclosed. The present paint ball land mine is designed to simulate the function of a U.S. military Claymore anti-personnel mine for purpose of marking participants as out of the competition in the simulated war game. The paintball land mine includes a cylindrical discharge tube configured to receive a pyrotechnic charge in the form of a 12 gauge shotgun blank round and/or a .38 caliber blank round. In a preferred embodiment a firing pin is pivotally attached in operative relation to the pyrotechnic charge and spring-biased into contact therewith. A trigger mechanism including a trip pin fixedly attached to a trip wire is interposed between the pyrotechnic charge and the firing pin. When a participant comes into contact with the trigger mechanism the paintballs are propelled at a velocity up to 200 feet per second.

8 Claims, 2 Drawing Sheets

PAINT BALL LAND MINE

CROSS-REFERENCE TO RELATED APPLICATION

This Application claims the benefit under 35 U.S.C. 119(e) of U.S. Provisional Application No. 60/074,760 filed Feb. 17, 1998 by Daniel W. Dolderer for Paint Ball Land Mine.

BACKGROUND OF INVENTION

1. Field of Invention

This invention relates generally to anti-personnel land mines and, more particularly, to a reusable land mine which propels small diameter paint balls.

The sport of paint ball in which individuals or teams of players participate in simulated war games has become increasingly popular in recent years. In paint ball the participants utilize various paint ball weapons which discharge small diameter paint balls to mark the players that have been hit without causing bodily injury.

Paint ball weapons have evolved from single shot pistols and rifles to include automatic weapons and other types of ordinance. For example, U.S. Pat. No. 5,590,886 discloses a reusable, mechanically powered paint ball grenade utilizing small diameter paint balls. Once thrown downrange the actuator will function upon impact allowing the grenade halves to collapse crushing the paint balls and causing the paint to be hydromechanically dispersed about the exterior of the device to mark nearby players.

The present invention has been developed to provide a paint ball land mine which is actuated by a trip wire mechanism to enhance the realism of such a simulated war game.

2. Description of Related Prior Art

U.S. Pat. No. 5,590,886 to Craig L. Lush discloses a reusable Paint Ball Grenade which is reloadable with standard caliber paint balls. This device is designed to be grasped in such a way as to engage one or more safety interlocks during the removal of the safety pin. Once thrown down range the actuator will upon impact allowing the grenade halves to be collapsed crushing the paint balls against cutters and causing the paint to be dispersed about the exterior of the device.

U.S. Pat. No. 4,690,061 to Leon N. Armer, Jr. et al. discloses a land mine for use in a simulated war game. The land mine device includes a housing having a first chamber adapted to contain a slurry of a marking agent and dispersing agent. A second chamber communicating with the first chamber is adapted to contain a propelling agent such as a cylinder of compressed gas. When a trigger mechanism is actuated the propellant is released into first chamber to drive the slurry from such chamber which in turn directs the slurry in a desired pattern exterior of the housing.

U.S. Pat. No. 4,833,961 to Ari Adini discloses a device for the dispersing of rioters which discharges a plurality of pieces of ice which preferably have a spherical shape and are fired at rioters by firing equipment which includes a barrel, a retaining element, and a loading part. The firing equipment further includes a source of pressure medium which is connected by a hose with the loading part of the firing device. The pressure medium source can be performed as an air compressor with an adjustable air pressure.

U.S. Pat. No. 5,207,579 to Carl J. Campagnuolo discloses a military anti-personnel mine training device which simulates battlefield explosive devices with bright flashes of light and buzzer type sounds which works in conjunction with systems that receive these sounds and in turn provide an indication of the damage which would have been inflicted on targeted personnel and equipment.

U.S. Pat. No. 2,972,949 to Norman A. Mac Leod discloses an antipersonnel fragmentation weapon used in close proximity to the defending users of the weapon and with which the only hazard will be from posterior or lateral blasts. The fragmentation beam is in the form of a solid angle, preferably having a horizontal aspect of from 45° to 90° and a vertical aspect of from 10° to 30°.

U.S. Pat. No. 2,475,008 to William S. Catherwood, Jr. discloses a land mine housing in which the base is constructed from sheet metal by stamping and welding operations such that the mine is considerably lighter in weight than the conventional cast iron mine base and is suitable for mass production at a comparatively reduced cost.

U.S. Pat. No. 5,149,290 discloses a portable, lightweight confetti cannon for projecting confetti to heights of 30 to 40 feet in the air to create a spectacular display for rock concerts or stage shows. The cannon consists of a hollow barrel having a length of at least 8 inches and a length/diameter ratio of at least 14 having a $CO_2$ cartridge radially mounted in the base. A valve is mounted between the cartridge and the barrel and has a cartridge puncturing mechanism which enables discharge of $CO_2$ cartridge contents in less than 3 seconds.

Finally, U.S. Pat. No. Des. 366,283 discloses the ornamental design for a paint ball mine as shown and described therein.

SUMMARY OF THE INVENTION

The present invention is a paint ball version of a so-called Claymore Mine as utilized by American troops during WWII, Korea, and Vietnam. The paint ball land mine will discharge paint balls or other marking agent at a velocity which will not inflict bodily injuly.

The paint ball land mine of the present invention utilizes a simple trip wire mechanism which triggers a propellant charge providing realism to the simulated war game. The present land mine is designed to be reloaded for repeated use.

Accordingly, it is an object of the present invention to provide a paint ball land mine which simulates the function of a so-called Claymore mine as known to U.S. military personnel.

Another object of the present invention is to provide a paint ball land mine which utilizes a simple trip wire mechanism and a propellant charge to enhance the realism of the simulated war games.

Another object of the present invention is to provide a paint ball land mine which is capable of delivering paint balls or other marking agent at high velocity without causing bodily injury.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
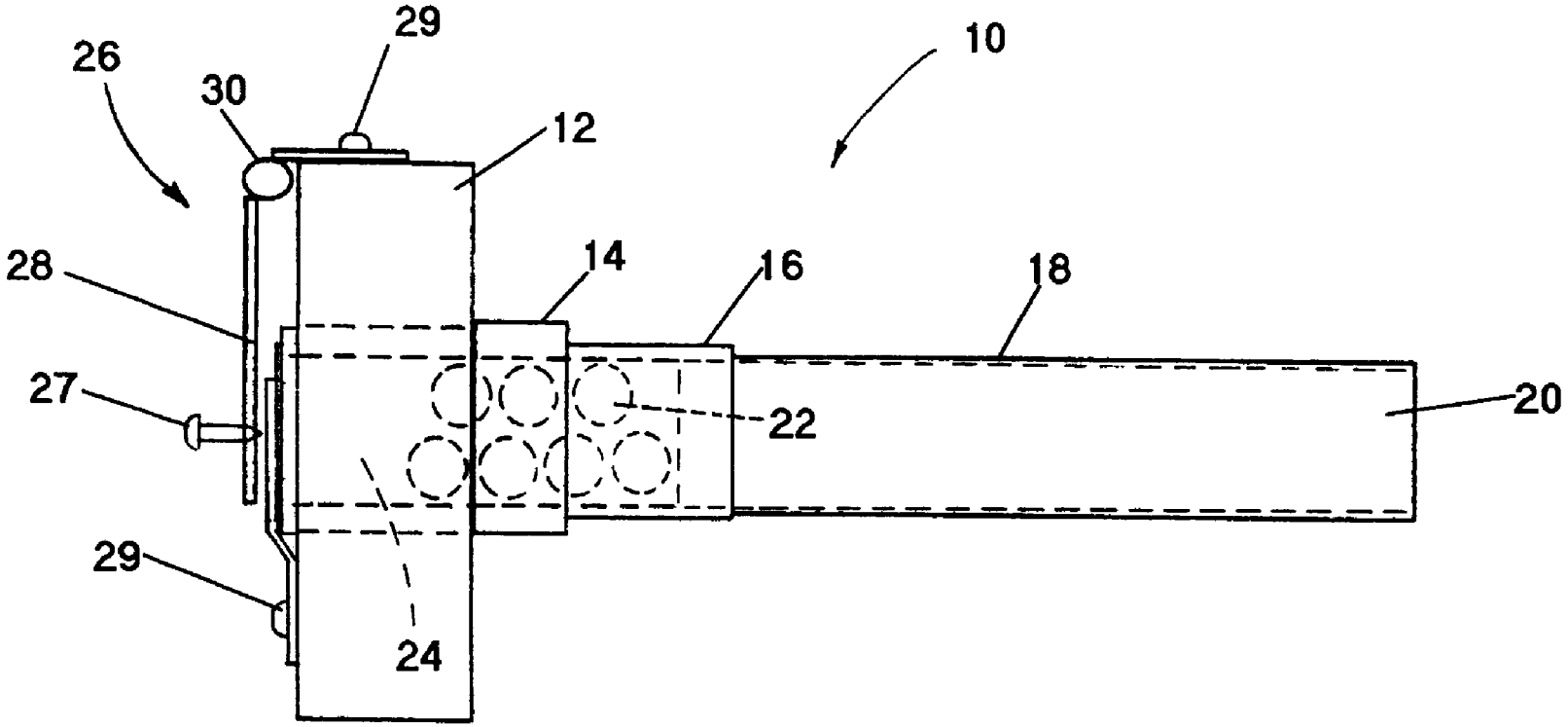
FIG. 1 illustrates a paint ball 1 and mine indicated generally at 10.

Referring to the drawings, FIG. 1 illustrates a paint ball land mine in accordance with the present invention, indicated generally at 10. The land mine 10 includes a base portion 12 having a cylindrical opening (not shown) formed therein in perpendicular relation thereto. In the embodiment shown a bushing 14 of predetermined internal diameter is installed in the opening in the base 12 to an interference fit.

The bushing 14 is threadably coupled to a collar 16 which is in turn threadably connected to the discharge tube 18 of the mine 10 to form a continuous internal bore 20 extending the entire length of the device.

In the preferred embodiment the bushing 14, coupling 16, and the discharge tube 18 are fabricated from a plastic material such as polyvinyl chloride (PVC) or other durable material.

In an alternative embodiment the discharge tube 18 together with the bushing 14 and the collar 16 may be of a unitary construction being integrally molded for this purpose.

The bushing 14 is adapted to receive a pyrotechnic charge to propel a plurality of paint balls 22 from the discharge tube 18 in operation. In the preferred embodiment, the pyrotechnic charge is in the form of a 12 gauge shotgun blank round 24 or other similar pyrotechnic charge. Such a charge 24 has been demonstrated to deliver paint balls 22 in a dispersed pattern at a velocity of 200 FPS without inflicting bodily injury.

In an alternative embodiment a .38 caliber blank round with an adapter bushing (not shown) can be utilized to propel the paint balls 22.

The mine 10 is provided with a firing pin assembly, indicated generally at 26 including a firing pin 27 which is installed in the pivoting member 28 of hinge 30 that is secured to the base 12 by screws 29 or other suitable attaching hardware.

Figure 2:
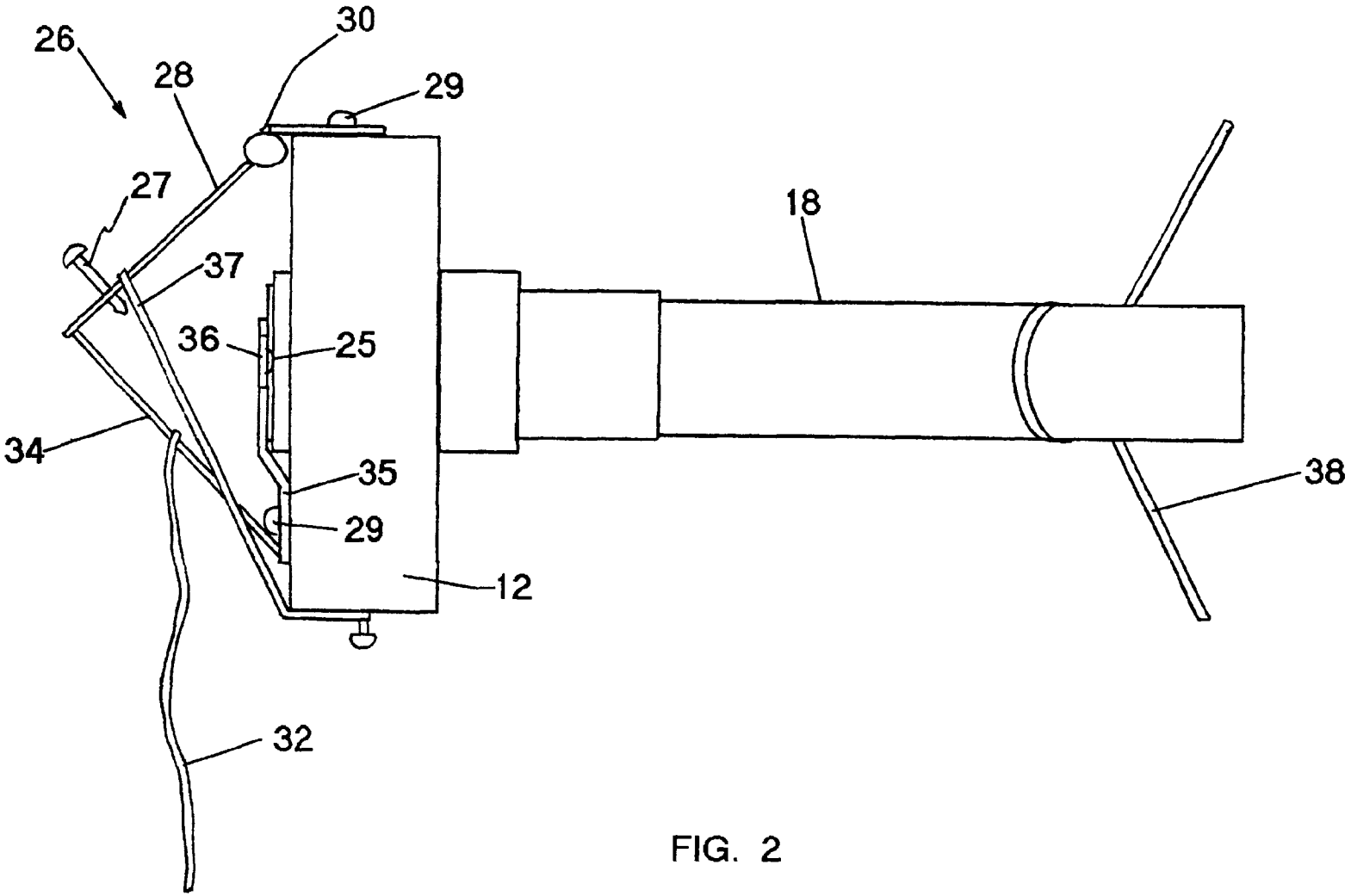
FIG. 2 shows the acutation and delivery system for the paint balls.

Referring now to FIG. 2, it can be seen that a simple trip wire 32 provides the trigger mechanism for the mine 10. The trip wire 32 is connected to a trip pin 34 which is held between the pivoting member 28 and the base 12 by the resistance of an elastic band or spring 37 that is anchored at one end thereof to the base 12 as at 39. An opposite end of the band 37 extends over the pivoting member 28 to effectively load the firing pin assembly 26.

In practical use the paint ball land mine 10 is initially loaded with a charge 24 together with the paint balls 22 or other bulk water-based paint cartridge (not shown) as shown in FIG. 1.

Next, the offset cartridge retainer 35 being pivotally attached by the screw 29 is swung into position to retain the charge 24. It will be appreciated that the retainer 35 includes an aperture 36 which is formed therein and is disposed in alignment with a detonator 25 of the charge 24.

Next, the elastic band 37 is positioned as shown in FIG. 2 and the pivoting member 28 of the hinge is drawn outwardly against the tension thereof. The trip pin 34 being attached to the trip wire 32 is inserted between the base 12 and the pivoting member 28 to place the mine in firing condition.

Thereafter, the mine 10 is positioned on the ground surface or other desired location and may be propped up at an angle by the use of a leg attachment 38 to aim the discharge tube 18 upwardly at a potential victim.

In the preferred embodiment, the entire device is painted flat black, in color or may be provided with a camouflage paint to hide its location.

During the course of a game of paint ball, if a participant comes into contact with the trip wire 32, the trip pin 34 will be pulled from the position shown in FIG. 2 releasing the firing pin 27 to fire the device propelling the paint balls 22 outwardly from the discharge tube and into contact with the lower extremities of the victim placing him out of the competition.

From the above it can be seen that the paint ball land mine of the present invention provides a device which simulates the function of a so-called Claymore mine enhancing the realism of a simulated war game.

The paint ball land mine of the present invention is capable of delivering paint balls in a dispersed pattern at a high velocity without inflicting bodily injury.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A paint ball land mine for propelling a paint cartridge with a detonation cartridge when contacted by a participant in a ground area, said paint ball land mine comprising: a base member for engaging the ground area; a cylindrical discharge tube on said base member defining a cylindrical bore having a discharge end and a cartridge end for receiving the detonation cartridge, the detonation cartridge having a detonation member facing outwardly of said base member; a retaining member connected to said base member adjacent said cartridge end and shiftable from a loading position permitting insertion of the detonation cartridge into said bore and a detonation position retaining the detonation cartridge in said bore; a pivot member pivotally connected to said base member and carrying a detonation pin for engaging the detonation member to initiate detonation thereof and propel the paint cartridges from said discharge tube, said pivot member having an armed position spaced from said base member and a detonation position whereat said detonation pin engages said cartridge member; a trip member extending between said base member and an outer end of said pivot member for maintaining said pivot member in said armed position; spring means operative for biasing said pivot member between said armed position and said detonation position; an a trip wire extending between said trip member and the ground area whereby contact of said trip wire by the participant will dislodge said trip member from said pivot member permitting said spring means to shift said pivot member from said armed position and said detonation position causing said detonation pin to engage said cartridge member thereby initiating detonation and propelling said pain cartridges from said tube.

2. The paint ball land mine as recited in claim 1 wherein said discharge tube includes a support leg slidably supported thereon for varying the angular elevation of said discharge tube with respect to the ground area.

3. The paint ball land mine as recited in claim 2 wherein said retaining member is pivotally connected to said base member about an axis parallel to said bore and includes an aperture aligned with cartridge member in said detonation position, and said detonation pin projects from said pivot member and registers with said aperture at said detonation position initiating said detonation.

4. The pain ball land mine as recited in claim 1 wherein said spring means is an elastic band.

5. The paint ball land mine as recited in claim 1 wherein said paint cartridge comprises a plurality of paint balls.

6. The paint ball land mine as recited in claim 3 wherein said bore accommodates a shot gun blank.

7. The paint ball land mine as recited in claim 3 wherein said bore accommodate a rifle blank.

8. The paint ball land mine as recited in claim 1 wherein said trip wire is a light gauge material.

* * * * *